US009226638B2

(12) United States Patent
Zeng et al.

(10) Patent No.: US 9,226,638 B2
(45) Date of Patent: Jan. 5, 2016

(54) MOP

(75) Inventors: Feng Zeng, Shanghai (CN); Weilai Jiang, Shanshai (CN); Liang Cheng, Shanghai (CN); Gianmauro Vella, Shanghai (CN)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/883,437

(22) PCT Filed: Nov. 4, 2010

(86) PCT No.: PCT/CN2010/078414

§ 371 (c)(1),
(2), (4) Date: May 3, 2013

(87) PCT Pub. No.: WO2012/058812

PCT Pub. Date: May 10, 2012

(65) Prior Publication Data

US 2013/0219646 A1 Aug. 29, 2013

(51) Int. Cl.

| | |
|---|---|
| ***A47L 13/20*** | (2006.01) |
| ***A47L 13/258*** | (2006.01) |
| *A47L 13/256* | (2006.01) |

(52) U.S. Cl.
CPC ..... *A47L 13/20* (2013.01); *A47L 13/258* (2013.01); *A47L 13/256* (2013.01)

(58) Field of Classification Search
CPC ..... A47L 13/258; A47L 13/256
USPC ..... 15/147.1, 147.2, 228, 231, 144.1, 144.2
See application file for complete search history.

(56) References Cited

U.S. PATENT DOCUMENTS

| | | | | | |
|---|---|---|---|---|---|
| 1,256,989 | A | * | 2/1918 | Duncan | 15/228 |
| 2,804,638 | A | * | 9/1957 | Vosbikian et al. | 15/229.8 |
| 3,692,369 | A | * | 9/1972 | Chase | 403/161 |
| 3,795,933 | A | * | 3/1974 | Seufert | 15/114 |
| 4,783,873 | A | * | 11/1988 | Young | 15/147.2 |
| 4,850,075 | A | * | 7/1989 | Kresse et al. | 15/228 |
| 5,218,734 | A | * | 6/1993 | Sacks | 15/147.2 |
| 5,361,447 | A | * | 11/1994 | Ophardt | 15/229.6 |
| 5,442,830 | A | * | 8/1995 | Ohm | 15/147.2 |
| 5,575,033 | A | * | 11/1996 | Nolte | 15/147.2 |
| 5,655,250 | A | * | 8/1997 | Warrell | 15/228 |
| 5,836,039 | A | * | 11/1998 | Rimer | 15/228 |
| 5,979,004 | A | * | 11/1999 | Wilson | 15/119.2 |
| 6,088,868 | A | * | 7/2000 | Cerveny | 15/144.3 |

(Continued)

FOREIGN PATENT DOCUMENTS

| | | |
|---|---|---|
| CN | 201091559 | 7/2008 |
| CN | 201481340 | 5/2010 |

(Continued)

OTHER PUBLICATIONS

International Search Report for International PCT Application No. PCT/CN2010/078414, Mailed on Aug. 11, 2011, 5 pages.

*Primary Examiner* — Monica Carter
*Assistant Examiner* — Michael Jennings

(57) ABSTRACT

A mop is disclosed. The mop comprises a mop head (1), a mop shank (2) and a joint (3) connecting the mop head (1) and the mop shank (2), wherein the mop head (1) comprises a cleaning face which is disposed to enable at least one part of the cleaning face to be dynamically switched relative to the other parts thereof, for forming a coplanar state or a non-coplanar state with the other parts.

12 Claims, 6 Drawing Sheets

(56) References Cited

U.S. PATENT DOCUMENTS

| | | | | |
|---|---|---|---|---|
| 6,785,928 | B2 * | 9/2004 | Specht et al. | 15/119.2 |
| 7,039,969 | B2 * | 5/2006 | Zorzo | 15/147.1 |
| 7,328,477 | B1 * | 2/2008 | Aiyar | 15/228 |
| 7,469,441 | B2 * | 12/2008 | Hirse | 15/119.2 |
| 7,496,985 | B1 * | 3/2009 | Morad | 15/228 |
| 7,716,776 | B2 * | 5/2010 | Bonnell et al. | 15/228 |
| 7,779,501 | B2 * | 8/2010 | Lacotta et al. | 15/118 |
| 7,882,589 | B2 * | 2/2011 | Nobile et al. | 15/244.1 |
| 7,908,701 | B1 * | 3/2011 | Aiyar | 15/228 |
| 8,266,756 | B1 * | 9/2012 | Kovarik | 15/210.1 |
| 8,356,379 | B2 * | 1/2013 | Fischer | 15/147.2 |
| 8,544,133 | B2 * | 10/2013 | Fischer et al. | 15/98 |
| 2004/0231700 | A1 | 11/2004 | Bell | |
| 2006/0016037 | A1 | 1/2006 | Flora | |
| 2006/0085935 | A1 * | 4/2006 | White, II | 15/228 |
| 2009/0158544 | A1 * | 6/2009 | Pagani | 15/228 |
| 2010/0162507 | A1 * | 7/2010 | Lee | 15/228 |
| 2011/0100395 | A1 * | 5/2011 | Van Landingham et al. | 134/6 |

FOREIGN PATENT DOCUMENTS

| | | |
|---|---|---|
| EP | 1955639 | 8/2008 |
| JP | 2005-270440 | 10/2005 |
| WO | WO 98-52458 | 11/1998 |
| WO | WO 98-52459 | 11/1998 |
| WO | WO 01-41622 | 6/2001 |
| WO | WO 2005-048805 | 6/2005 |
| WO | WO 2009-072057 | 6/2009 |

* cited by examiner

MOP

CROSS REFERENCE TO RELATED APPLICATIONS

This application is a national stage filing under 35 U.S.C. 371 of PCT/CN2010/078414, filed Nov. 4, 2010, the disclosure of which is incorporated by reference in its entirety herein.

BACKGROUND OF INVENTION

1. Field of Invention

The present invention relates to household cleaning apparatus, more particularly, to a mop for house cleaning.

2. Description of the Related Arts

As shown in FIG. 1, floor cleaning tools currently available for household are known as flat plate mops or flat mops. The flat mop generally has a mop shank 200 to be hold by the user, a mop head 100 installed thereon with a mop cloth 110 made of disposable cleaning material as well as a hinging joint (not shown) connecting the mop shank 200 and the mop head 100. Usually, the user holds the mop shank 200 and drives the mop head 100 carrying the mop cloth 110, so that the mop cloth 110 is brought to directly contact with the floor and to rub against the floor back and forth so as to achieve cleaning of the floor.

Currently, the mop head of the common flat mop available in the market generally has a flat bottom surface. Due to this, when the mop head 100 is moved over the floor (along the directions as shown by the left and right arrows in FIG. 1) to clean dust, the dust on the floor is only heaped at an edge of a cleaning face at bottom of the mop head 100, while the middle portion of the cleaning face of the mop head 100 can not be utilized, i.e., being so called "snow plowing effect". Therefore, on one hand, the use efficiency of the cleaning material is poor and thus the cleaning effect is not satisfactory; on the other hand, it is nearly possible for the large pieces of dust over the floor to be brought into contact with the cleaning material. Consequently, dust can only be moved from one position to another position, and can not be taken away. In this case, the user has to make secondary cleaning by other known means.

SUMMARY OF INVENTION

Bearing in mind of the above shortages in prior arts, an object of the present invention is to alleviate at least one aspect of the above problems and defects.

Accordingly, at least one aspect of the present invention is to provide a mop, wherein a mop head of the mop comprises a cleaning face which is disposed to enable at least one part of the cleaning face to be dynamically switched relative to the other parts thereof, for example in response to the application of the external force, for forming a coplanar state or a non-coplanar state with the other parts.

In one embodiment, there is to provide a mop, comprising: a mop head; a mop shank; a joint connecting the mop head and the mop shank, wherein the mop head comprises a cleaning face which is disposed to enable at least one part of the cleaning face to be dynamically switched relative to the other parts thereof, for forming a coplanar state or a non-coplanar state with the other parts.

In one embodiment, the cleaning face comprises a first end portion and a second end portion of the cleaning face which are articulated by a hinge device, so that the first end portion of the cleaning face can be pivoted relative to the second end portion of the cleaning face.

In one embodiment, the cleaning face comprises a first end portion of the cleaning face and a second end portion of the cleaning face which are integral and flexible so that the first end portion of the cleaning face can be warped relative to the second end portion of the cleaning face; or the first end portion of the cleaning face is flexible and flexibly connected to the second end portion of the cleaning face so that the first end portion of the cleaning face can be warped relative to the second end portion of the cleaning face.

In one embodiment, the mop head is provided with a position-limit mechanism and a driving device, the position-limit mechanism is located at the mop head to define a position of the joint, the driving device is placed between the hinge device and the joint to exert a driving force therebetween.

In one embodiment, the first end portion of the cleaning face is connected to the joint by a crowbar stripe, when a force is exerted on the mop head through the mop shank, the joint is brought into contact with the crowbar stripe and the first end portion of the cleaning face is rotated about the hinge device.

In one embodiment, the driving device comprises a spring which may be a coil spring and/or a flat spring.

In one embodiment, the position-limit mechanism is located at a position close to a center of the mop head.

In one embodiment, the cleaning face comprises a first end portion of the cleaning face, a second end portion of the cleaning face and a first middle portion of the cleaning face disposed therebetween, the first end portion of the cleaning face and the second end portion of the cleaning face are respectively articulated with the first middle portion of the cleaning face by a hinge device, so that the first end portion of the cleaning face and the second end portion of the cleaning face can be pivoted relative to the first middle portion of the cleaning face.

In one embodiment, the cleaning face comprises a first end portion of the cleaning face, a second end portion of the cleaning face and a first middle portion of the cleaning face disposed therebetween, the first end portion of the cleaning face, the second end portion of the cleaning face and the first middle portion of the cleaning face are integral and flexible so that the first end portion of the cleaning face and the second end portion of the cleaning face can be warped relative to the first middle portion of the cleaning face; or the first end portion of the cleaning face and the second end portion of the cleaning face are flexible and flexibly connected to the first middle portion of the cleaning face so that the first end portion of the cleaning face and the second end portion of the cleaning face can be warped relative to the first middle portion of the cleaning face.

In one embodiment, the mop head is provided with a position-limit mechanism and two driving devices, the position-limit mechanism is located at the first middle portion of the cleaning face to define a position of the joint, the two driving devices are respectively placed between the corresponding hinge device and the joint, to exert a driving force therebetween respectively.

In one embodiment, the first end portion of the cleaning face and the second end portion of the cleaning face are respectively connected to the joint by a crowbar stripe, when a force is exerted on the mop head through the mop shank, the joint is brought into contact with the crowbar stripe, and the first end portion of the cleaning face and the second end portion of the cleaning face are rotated about the respective hinge device.

In one embodiment, the driving device comprises a spring which may be a coil spring and/or a flat spring.

In one embodiment, the position-limit mechanism is located at a position close to a center of the first middle portion of the cleaning face.

In one embodiment, the cleaning face has a substantially planar surface having a plurality of convex and concave peaks and valleys therein.

In one embodiment, the end of the mop head at least comprises a cleaning material disposed on the mop head and a gripping mechanism, for fixing the cleaning material thereon.

In one embodiment, the cleaning face is a flat sponge.

The disclosed mop has a cleaning face, wherein when being pushed forward, at least one part of the cleaning face can be raised to form a non-coplanar state with the other part thereof. As continually being pushed forward, the dust over the floor can be brought to enter into the bottom of the cleaning face to be raised and can be adhered to the cleaning material installed on the cleaning face. While the mop is pulled backward, the raised portion of the cleaning face can be restored back to a coplanar state with the other part of the cleaning face, i.e., to be in one plane. In this way, the dust to be cleaned can be adhered to the cleaning material of the cleaning face and be taken away. As a result, the dust collecting ratio is significantly improved by the disclosed mop. The disclosed mop not only enhances the cleaning performance of the small dust, but also can clean the large pieces of dust, thus advantageous over the current common mop.

BRIEF DESCRIPTION OF THE DRAWINGS

Those and/or other aspect and advantages can be apparent and readily understood from the following description of the preferred embodiment, in combination with the accompanying drawings, wherein.

DETAILED DESCRIPTION OF PREFERRED EMBODIMENTS

Figure 1:
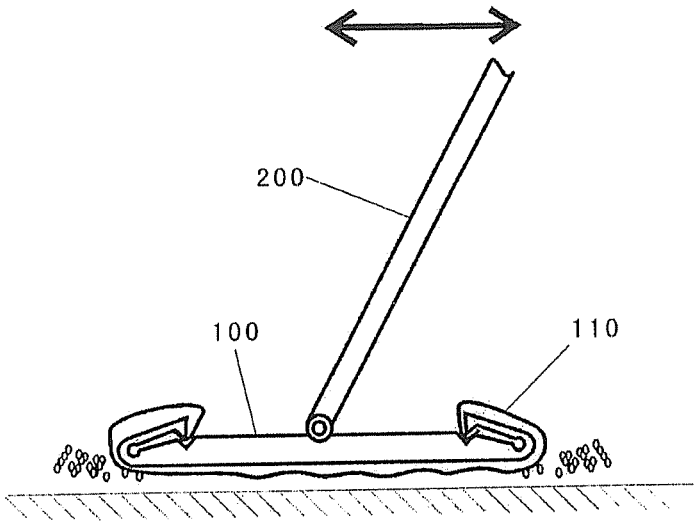
FIG. 1 depicts a schematic view of a mop in the prior art.

Exemplary embodiments of the present disclosure will be described hereinafter in detail with reference to the specific examples. It is apparent for those skilled in the art to understand configurations, advantages and functionality of the present invention from the disclosure of the following embodiment.

The disclosed mop can also be implemented or applied by other different embodiments. Various details of the description can be modified or altered based on different concepts and applications without departing from the spirits of the present invention.

Moreover, the attached drawings are simplified views to schematically convey the basic concept of the present invention. Therefore, the drawing only illustrates the related assembly to the present invention, while failing to delimit the number, shapes and sizes of the assembly as implemented. When implementing the present invention, the shapes, number and the scale can be altered as required.

A mop is illustrated in FIGS. 2-6. The mop comprise: a mop head 1; a mop shank 2; a joint(for example a hinging joint) 3 connecting the mop head 1 and the mop shank 2. Further, the mop head 1 comprises a cleaning face which is disposed to enable at least one part of the cleaning face to be dynamically switched relative to the other parts thereof, for forming a coplanar state or a non-coplanar state with the other parts. In one embodiment, this transformation can be achieved by application of an external force. Moreover, the end of the mop head 1 at least comprises a cleaning material 11 disposed on the mop head 1 and a gripping mechanism 12 (for example clip or clamp), for fixing the cleaning material 11 thereon. In one embodiment, the disclosed mop can be a flat sponge wet cleaning mop. Specifically, the cleaning face is a flat sponge. In other words, the disclosed flat sponge wet cleaning mop can work without the cleaning material 11 as disclosed above.

First Embodiment

Figure 2:
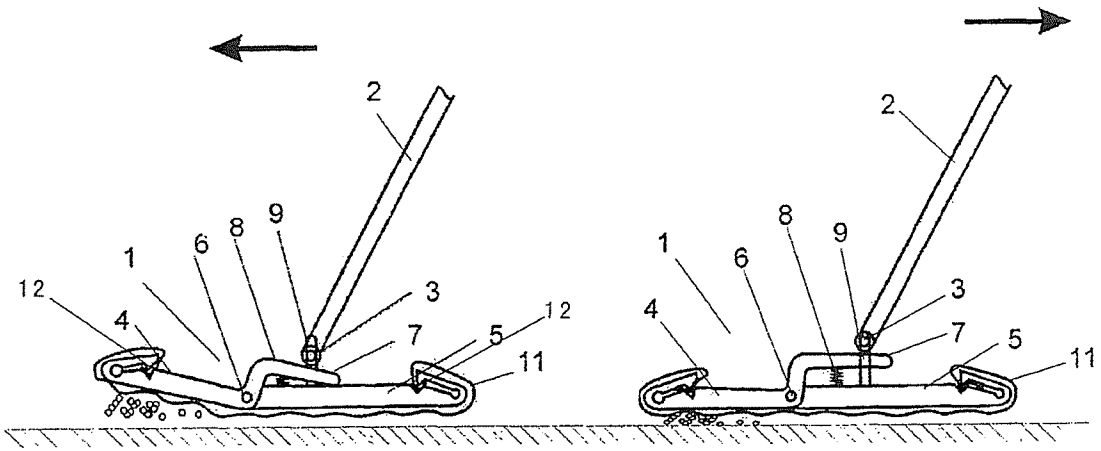
FIG. 2 depicts a schematic view of a first embodiment of a mop.

Specifically referring to FIG. 2, the cleaning face comprises a first end portion 4 of the cleaning face and a second end portion 5 of the cleaning face which are articulated by a hinge device 6, so that the first end portion 4 of the cleaning face can be pivoted relative to the second end portion 5 of the cleaning face. In practice, the mop head 1 generally is sheet shaped or flat plate shaped. It should be appreciated that in this case both of the first end portion 4 of the cleaning face and the second end portion 5 of the cleaning face can be rigid so as to be rotated through the hinge device 6.

In present embodiment, the mop head 1 is provided with a position-limit mechanism 9 and a driving device 8, and the position-limit mechanism 9 is located at the mop head 1 to define a position of the hinging joint 3. It should be understood that the position-limit mechanism 9 can be positioned at any position of the mop head 1, as long as the position-limit mechanism 9 can define the hinging joint 3. The person skilled in the art shall note that the area of the first end portion 4 of cleaning face, which is to be raised in the mop head 1 can be adjusted by the position setting of the position-limit mechanism 9. As shown in FIG. 2, in a specific example, the position-limit mechanism 9 in the present embodiment is located at a position close to a center of the mop head 1. Apparently, the position-limit mechanism 9 can be set closer or farther than that depicted by FIG. 2 from a distal end of the second end portion 5 of the cleaning face. On one hand, when the position-limit mechanism 9 is disposed closer than that shown by FIG. 2 from the distal end of the second end portion 5 of the cleaning face, this can increase the area of the first end portion 4 of the cleaning face to be raised, and accordingly enhance the cleaning efficiency of the mop. It should be noted that when the position-limit mechanism 9 is biased too much, this will impose adverse affect the comfort of the operator during the operation of the mop. On the other hand, when the position-limit mechanism 9 is disposed farther than that shown by FIG. 2 from the distal end of the second end portion 5 of the cleaning face, this can reduce the area of the first end portion 4 of the cleaning face to be raised, and accordingly decreasing the cleaning efficiency of the mop. Therefore, the positioning of the position-limit mechanism 9 can be selected depending on the situation as required.

Further, the driving device 8 is placed between the hinge device 6 and the hinging joint 3 to exert a driving force therebetween. Preferably, the driving device 8 comprises a spring which may be a coil spring and/or a flat spring. In the present embodiment, the driving device 8 is a coil spring.

Further, a crowbar stripe 7 is disposed at one end of the first end portion 4 of the cleaning face, which is close to the hinging joint 3. When a force is exerted on the mop head 1 through the mop shank 2, the hinging joint 3 is brought into contact with the crowbar stripe 7 and the first end portion 4 of the cleaning face is rotated about the hinge device 6.

It is noted that since the first end portion 4 of the cleaning face and the second end portion 5 of the cleaning face are articulated by the hinge device (for example a hinge) 6, the first end portion 4 of the cleaning face is rotated about the second end portion 5 of the cleaning face within a certain angle range, to enable the first end portion 4 of cleaning face of the mop head 1 to be closed and open relative the floor. The crowbar stripe 7 is arranged at the rear end of the first end portion of the cleaning face 4 (close to the position-limit mechanism 9), and is used to contact with the hinging joint 3 at the bottom of the mop shank 2. When the downward force from the hinging joint 3 reaches a certain level, the first end portion 4 of the cleaning face begins to rotate about the hinge 6 and thus is raised. Finally, the first end portion 4 of the cleaning face is transferred or switched from the coplanar state with the second end portion 5 of the cleaning face (as shown by a schematic view at right side of FIG. 2) to the non-coplanar state (as shown by a schematic view at left side of FIG. 2). When the downward force acting on the crowbar stripe 7 at rear end of the first end portion 4 of the cleaning face decreases to a certain level, the first end portion 4 of the cleaning face is restored back to the coplanar state with the second end portion 5 of the cleaning face by the action of the driving device 8.

With this arrangement, by utilizing the natural action of the user during the cleaning floor, the first end portion 4 of the cleaning face of the mop head 1 will automatically be brought to be open and closed relative to the floor to be cleaned (i.e., the first end portion 4 of the cleaning face is raised from the floor and flush with the floor). When forwardly pushing the mop head 1 (i.e., along the direction as shown by the left arrow of FIG. 2), due to the counter force of the frictional resistance from the floor, a downward force is naturally generated at the lower end of the mop shank 2, and is passed to the crowbar strip 7 at rear end of the first end portion 4 of the cleaning face, resulting the first end portion 4 of the cleaning face to be naturally opened. Therefore, there is a gradually opened up gap (in this case which is dynamic wedge gap) between the first end portion 4 of the cleaning face of the mop head 1 and the floor. As the first end portion 4 of the cleaning face of the mop head 1 is moved forward continually, the dust over the floor will enter into the middle portion of the cleaning face at the bottom of the mop head 1 and is adhered to the cleaning material 11. When the mop head 1 is pulled backward (along the direction shown by right arrow of FIG. 2), as well due to the counter force of the frictional resistance from the floor, the above described downward force from the mop shank 2 will disappear, and thus the first end portion 4 of cleaning face of the mop head 1 will be restored back to the coplanar state (i.e., to be in one plane) with the second end portion 5 of the cleaning face by the action of driving device 8. In this way, the dust to be picked up is adhered to the cleaning material on the cleaning face and is taken away.

Figure 3:
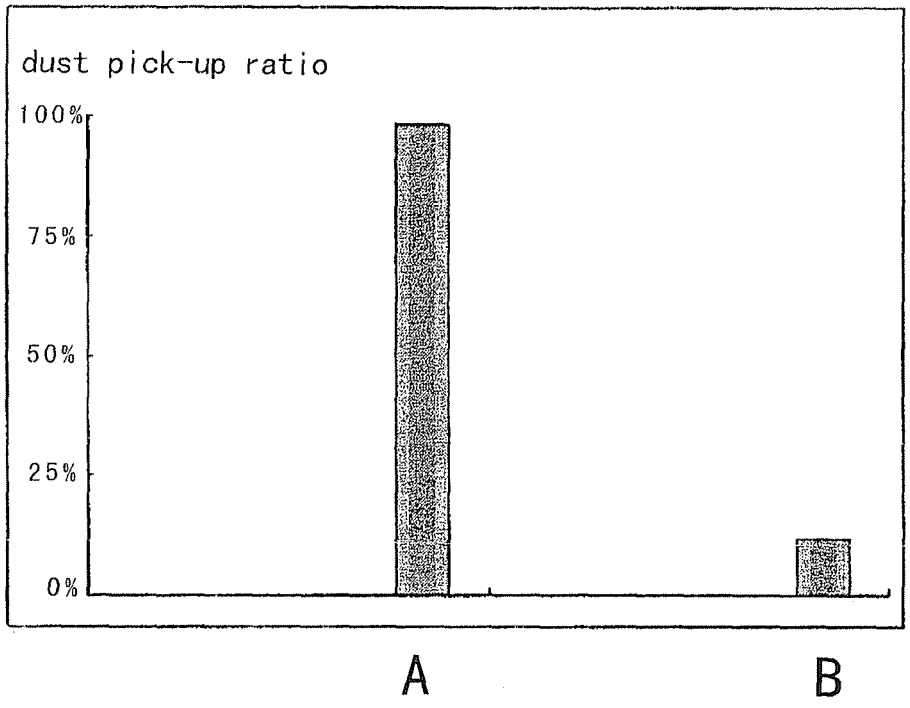
FIG. 3 is a diagram of comparing the mop of the first embodiment with the mop as shown in FIG. 1 in terms of dust pick-up ratio.

In order to demonstrate the mop of the present invention to have an excellent cleaning performance over the common flat mop, the comparison test is performed by recording the dust pick-up ratio in accordance with the following standard test method, as shown in table 1 and FIG. 3.

TABLE 1

| Standard Test Method |
|---|
| Floor Condition: evenly clean ceramic tile having an area of 1200 × 800 mm |
| Cleaning material: 400 g/m$^2$ microfiber cleaning material at 110% water contain ratio |
| Type of Dust: 0.3 g hair and cotton line |
| Use state and method of Mop: The mop is dragged at Z route three passes with the mop shank being titled from the floor to be cleaned at an angle 45° |
| Test Environment: room temperature, room humidity, and without air in the room |

Specifically, as shown by FIG. 3, the dust pick-up ratio of the mop of the present invention is 100% (which is marked as a character A in FIG. 3), while the dust pick-up ratio of the common flat mop as shown in FIG. 1 is only 10% (which is marked as a character B in FIG. 3). Thus, it can be seen from the above that as compared with the common flat mop, the technical solution provided by the present invention not only significantly improves the performance of cleaning the small dust, but also can clean the larger dust.

Second Embodiment

It should be understood that the cleaning face of the present invention can be the form shown by FIG. 2, i.e., the first end portion 4 of the cleaning face and the second end portion 5 of the cleaning face both are made of rigid material, and are articulated by the hinge device (hinge) 6. Apparently, the cleaning face of the present invention can be designed as the form shown by FIG. 4, i.e., the cleaning face comprises a first end portion 4 and a second end portion 5 of the cleaning face which are integral and flexible so that the first end portion 4 of the cleaning face can be warped relative to the second end portion 5 of the cleaning face; or the first end portion 4 of the cleaning face is flexible and flexibly connected to the second end portion 5 of the cleaning face so that the first end portion 4 of the cleaning face can be warped relative to the second end portion 5 of the cleaning face.

Figure 4:
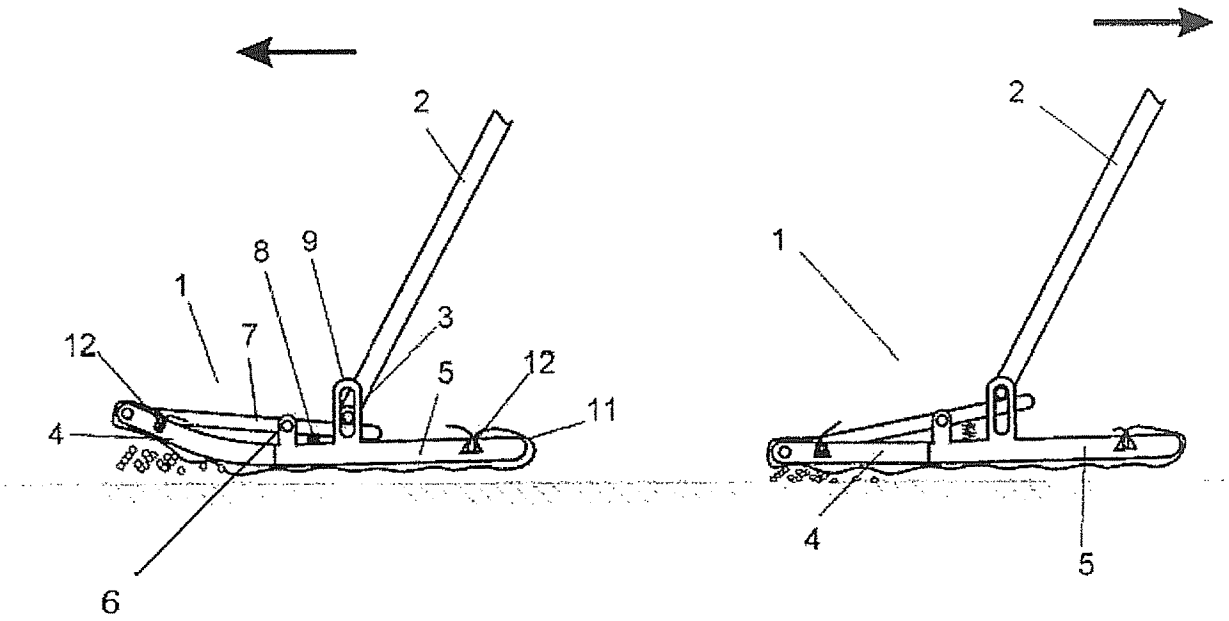
FIG. 4 depicts a schematic view of a second embodiment of a mop.

As shown in FIG. 4, with respect to the mop of the first embodiment, the mop of the second embodiment has differences in the material and connection of the first end portion 4 and second end portion 5 of the cleaning face as well as the setting of the hinge device 6 and the crowbar stripe 7, and accordingly, the other parts of the mop as described in the second embodiment are the same as that of the first embodiment. Thus, the description for other parts of the mop in the second embodiment is omitted for brevity. Hereinafter, the descriptions are mainly focused on different aspects from the first embodiment.

As described above, since in the second embodiment of the present invention at least one part of the cleaning face is flexible, the transformation of the cleaning face between the coplanar state and the non-coplanar state is different from that shown by FIG. 2. It should be understood that the cleaning face in the second embodiment can be a flat sponge or the like. Specifically, the hinge device 6 is substantially disposed at a position close to a center of the mop head 1 and is projected to a certain height over the generally flat portion of the mop head 1, to provide a support point for pivoting the crowbar stripe 7 described hereinafter. Additionally, the crowbar stripe 7 is connected to the hinge device 6 so that both ends of the crowbar stripe 7 are located at two sides of the hinge device 6 respectively. Particularly, one end of the crowbar stripe 7 is connected to the end of the first end portion 4 of the cleaning face far away from the hinge device 6, while the other end of the crowbar stripe 7 extends beyond the hinging joint 3 and is connected to the hinging joint 3.

With this arrangement, the cleaning face is enabled to transfer or switch between the coplanar state and the non-coplanar state. The specific process is as follows: when the downward force from the hinging joint 3 reaches a certain level, due to the contact of the hinging joint 3 with one end of the crowbar stripe 7, the first end portion 4 of the cleaning face begins to rotate about the hinge 6 and thus is gradually warped upward. Finally, the first end portion 4 of the cleaning face is transferred from the coplanar state with the second end portion 5 of the cleaning face (as shown by a schematic view at right side of FIG. 4) to the non-coplanar state (as shown by a schematic view at left side of FIG. 4). When the downward force acting on the crowbar stripe 7 at rear end of the first end portion 4 of the cleaning face decreases to a certain level, the first end portion 4 of the cleaning face is restored back to the coplanar state with the second end portion 5 of the cleaning face by the action of the driving device 8 between the hinge device 6 and the hinging joint 3.

Third Embodiment

Figure 5:
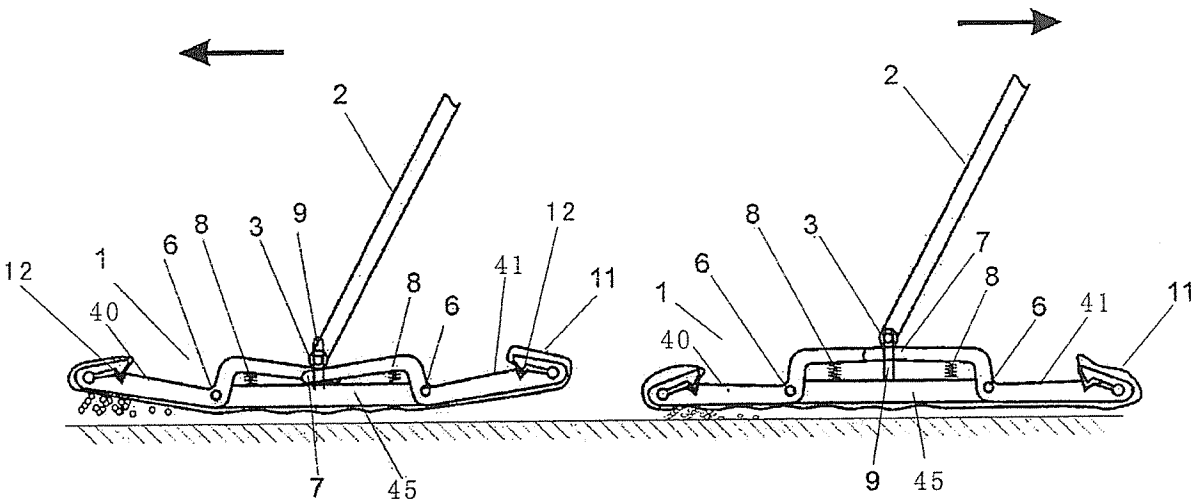
FIG. 5 depicts a schematic view of a third embodiment of a mop.

As shown FIG. 5, the third embodiment provides another variation of the mop of the present invention. The differences of the mop provided by the third embodiment from that of the first embodiment lie in that, the cleaning face of the mop in accordance with the third embodiment has at least three portions. For the sake of simplicity, the present embodiment only illustrates three portions, which are respectively a first end portion 40 of the cleaning face, a second end portion 41 of the cleaning face and a first middle portion 45. Since it is necessary to enable the first end portion 40 and the second end portion 41 of the cleaning face relative to the first middle portion 45 of the cleaning face therebetween, to be transferred between the coplanar state and the non-coplanar state, two hinge devices 6, two driving devices 8 and two crowbar stripes 7 are provided.

In the present embodiment, the cleaning face of the mop head 1 in accordance with the third embodiment comprises a first end portion 40 of the cleaning face, a second end portion 41 of the cleaning face and a first middle portion 45 of the cleaning face disposed therebetween. The first end portion 40 of the cleaning face and the second end portion 41 of the cleaning face are respectively articulated with the first middle portion 45 of the cleaning face by a hinge device 6, so that the first end portion 40 of the cleaning face and the second end portion 41 of the cleaning face can be pivoted relative to the first middle portion 45 of the cleaning face.

Further, the mop head 1 is provided with a position-limit mechanism 9 and two driving devices 8. The position-limit mechanism 9 is located at the first middle portion 45 of the cleaning face to define a position of the hinging joint 3. The two driving devices 8 each is placed between the corresponding hinge device 6 and the hinging joint 3, to exert a driving force therebetween respectively. It should be appreciated that the position-limit mechanism 9 can be disposed at any position of the mop head 1, as long as it can define the hinging joint 3.

As shown in FIG. 5, in the present embodiment, the position-limit mechanism 9 is substantially placed at a position close to the center of the first middle portion 45 of the cleaning face. Apparently, the positioning of the position-limit mechanism 9 can be selected depending on the actual need. Preferably, the driving device 8 can be a spring which comprises a coil spring and/or a flat spring. In the third embodiment, the driving device 8 is a coil spring.

In addition, a crowbar stripe 7 is respectively disposed at an end of the first end portion 40 and the second end portion 41 of the cleaning face close to the hinging joint 3. When a force is exerted on the mop head 1 through the mop shank 2, the hinging joint 3 is brought into contact with the crowbar stripe 7, and the first end portion of the cleaning face 40 and the second end portion of the cleaning face 41 are rotated about the respective hinge device 6.

It is noted that since the first end portion 40 and the second end portion 41 of the cleaning face with the first middle portion 45 of the cleaning face are articulated by the hinge device (for example a hinge) 6, the first end portion 40 and the second end portion 41 of the cleaning face are rotated about the first middle portion 45 of the cleaning face within a certain angle range, to enable the first end portion 40 and the second end portion 41 of the cleaning face of the mop head 1 to be closed and open relative the floor. The crowbar stripes 7 are arranged at the rear end of the first end portion 40 and the second end portion 41 of the cleaning face (close to the position-limit mechanism 9), and are used to contact with the hinging joint 3 at the bottom of the mop shank 2. When the downward force from the hinging joint 3 reaches a certain level, the first end portion 40 and the second end portion 41 of the cleaning face begin to rotate about the hinge 6 and thus are raised. Finally, the first end portion 40 and the second end portion 41 of the cleaning face are transferred from the coplanar state from the first middle portion 45 of the cleaning face (as shown by a schematic view at right side of FIG. 5) to the non-coplanar state (as shown by a schematic view at left side of FIG. 5). When the downward force acting on the crowbar stripe 7 at rear end of the first end portion 40 and the second end portion 41 of the cleaning face decrease to a certain level, the first end portion 40 and the second end portion 41 of the cleaning face are restored back to the coplanar state with the first middle portion 45 of the cleaning face by the action of the driving device 8.

With this arrangement, by utilizing the natural action of the user during the cleaning floor, the first end portion 40 and the second end portion 41 of the cleaning face of the mop head 1 will automatically achieve to be open and closed relative to the floor to be cleaned (i.e., the first end portion 40 and the second end portion 41 of the cleaning face are raised from the floor and flush with the floor). When forwardly pushing the mop head 1 (i.e., along the direction as shown by the left arrow of FIG. 5), due to the counter force of the frictional resistance from the floor, a downward force is naturally generated at the lower end of the mop shank 2, and is passed to the crowbar strip 7 at rear end of the first end portion 40 and the second end portion 41 of the cleaning face, resulting the first end portion 40 and the second end portion 41 of the cleaning face to be naturally opened. Therefore, there is a gradually opened up gap (in this case which is dynamic wedge gap) between the first end portion 40 and the second end portion 41 of the cleaning face 4 of the mop head 1 and the floor. As the cleaning face at the bottom of the mop head 1 is moved forward continually, the dust over the floor will enter into the middle portion of the cleaning face at the bottom of the mop head 1 and be adhered to the cleaning material 11. When the mop head 1 is pulled backward (along the direction shown by right arrow of FIG. 5), due to the counter force of the frictional resistance from the floor, the above described downward force from the lower end of the mop shank 2 will disappear, and thus the first end portion 40 and the second end portion 41 of cleaning face of the mop head 1 will be restored back to the coplanar state (i.e., to be in one plane) with the first middle portion 45 of the cleaning face by the action of driving device 8. In this way, the dust to be picked up is adhered to the cleaning material on the cleaning face and taken away.

As compared with the first and second embodiments, the front end and the rear end of the mop head 1 in the third embodiment are identical, thus the user does not need to take care of the use end to be which end and will not misuse the mop head.

Fourth Embodiment

Figure 6:
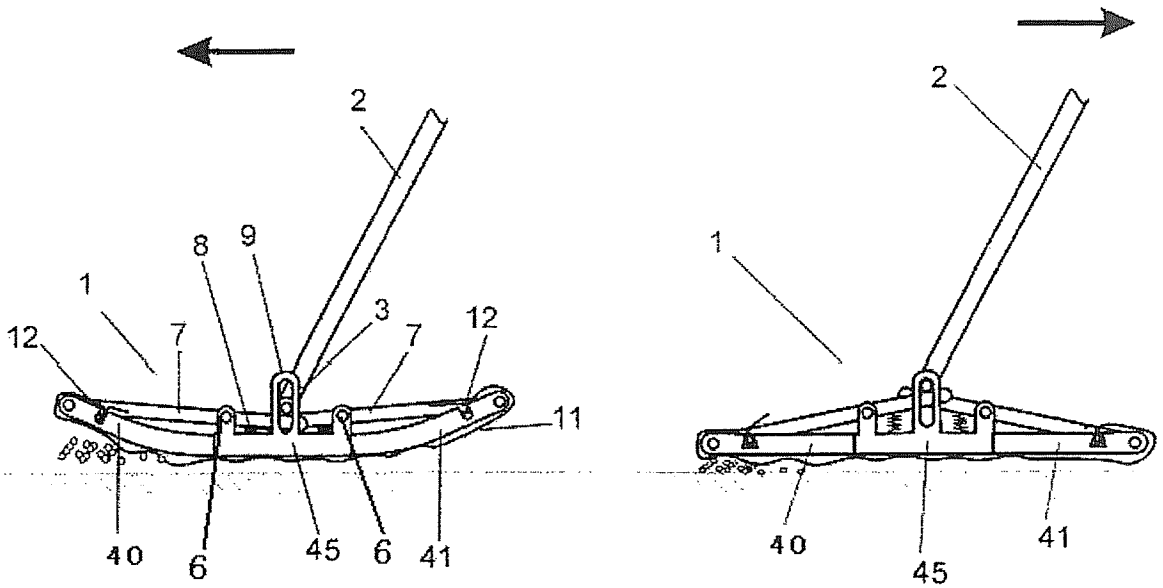
FIG. 6 depicts a schematic view of a fourth embodiment of a mop.

Referring to FIG. 6, when the cleaning face of the mop head 1 is made of flexible materials, or both ends thereof are made of flexible materials, the mop in this case can achieve the effect that both ends of the mop head as shown in FIG. 5 are wrapped relative to the middle portion thereof. The mop head of the fourth embodiment is generally similar to that of the second embodiment, while the differences therebetween lie in that a first end portion 40 and a second end portion 41 of the cleaning face are wrapped relative to a first middle portion 45 of the cleaning face by utilizing the same principle as that of the second embodiment, but two hinge devices 6, two driving devices 8 and two crowbar stripes 7 are disposed in the fourth embodiment.

As shown in FIG. 6, the two hinge devices 6 are substantially disposed at a both ends of the first middle portion 45 of the mop head 1 and are projected to a certain height over the generally flat portion of the mop head 1. Additionally, each crowbar stripe 7 is connected to each hinge device 6 so that both ends of the crowbar stripe 7 are located at two sides of the respective hinge device 6 respectively. Particularly, one end of one crowbar stripe 7 is connected to the end of the first end portion 40 of the cleaning face far away from the hinge device 6, while the other end of the one crowbar stripe 7 extends beyond the hinging joint 3 and is connected to the hinging joint 3; meanwhile, one end of another crowbar stripe 7 is connected to the end of the second end portion 41 of the cleaning face far away from the hinge device 6, while the other end of the another crowbar stripe 7 extends beyond the hinging joint 3 and is connected to the hinging joint 3.

With this arrangement, the cleaning face is enabled to transfer or switch between the coplanar state and the non-coplanar state. The specific process is as follows: when the downward force from the hinging joint 3 reaches a certain level, due to the contact of the hinging joint 3 with one end of the respective crowbar stripe 7, the first end portion 40 and the second end portion 41 of the cleaning face begin to rotate about the hinge 6 and thus are gradually warped upwardly. Finally, the first end portion 40 and the second end portion 41 of the cleaning face are simultaneously transferred from the coplanar state with the first middle portion 45 of the cleaning face (as shown by a schematic view at right side of FIG. 6) to the non-coplanar state (as shown by a schematic view at left side of FIG. 6). When the downward force acting on the crowbar stripe 7 at rear end of the first end portion 40 and the second end portion 41 of the cleaning face decreases to a certain level, the first end portion 40 and the second end portion 41 of the cleaning face are restored back to the coplanar state with the first middle portion 45 of the cleaning face by the action of the respective driving device 8 between the hinge device 6 and the hinging joint 3. It should be understood that the cleaning face in the fourth embodiment can be a flat sponge or the like.

In another embodiment of the present invention, the at least one part of the cleaning face is disposed to have substantially planar surface with a plurality of convex and concave peaks and valleys, on the basis of the mop provided by the above described embodiments. It should be understood that this arrangement can enable to further improve the dust pick-up efficiency of the mop.

Concerning the above, as compared with the prior art, the mop of the present invention has a cleaning face, wherein when being pushed forward, at least one part of the cleaning face can be raised to form a non-coplanar state with the other part thereof. As continually being pushed forward, the dust over the floor can be brought to enter into the bottom of the cleaning face to be raised and can be adhered to the cleaning material installed on the cleaning face. While the mop is pulled backward, the raised portion of the cleaning face can be restored back to a coplanar state with the other part of the cleaning face, i.e., to be in one plane. In this way, the dust to be cleaned can be adhered to the cleaning material of the cleaning face and be taken away. As a result, the dust pick-up ratio is significantly improved by the mop of the present invention. The mop of the present invention not only enhances the cleaning performance of the small dust, but also can clean the large dust, when comparing with the current common flat mop.

Although the embodiments of the present invention describe the principles and functionality thereof by way of example only, the present invention is not limited to this. It would be appreciated by those skilled in the art that many modifications, alterations and substitutions may be made in these embodiments without departing from the principles and spirit of the invention, the scope of which is defined in the claims and their equivalents.

What the claim is:

1. A mop, comprising:

a mop head comprising a cleaning face including a first end portion and a second end portion, the first end portion interconnected to the second end portion by a hinge device so that the first end portion can be pivoted about the hinge device relative to the second end portion for forming a coplanar state or a non-coplanar state with the second end portion;

a mop shank;

a joint connecting the mop head and the mop shank;

a position-limit mechanism interfacing with the joint to limit movement of the joint relative to the mop head, wherein the position-limit mechanism includes a slotted opening, and further wherein the joint is moveable within the slotted opening; and a drive device positioned between the hinge device and the joint to bias the mop head to the coplanar state;

wherein the mop is configured such that the non-coplanar state between the first and second end portions is realized when a downward force is exerted on the mop shank in a direction of the mop head;

and further wherein the non-coplanar state includes a forward edge of the first end portion, opposite the second end portion, extending upward in a direction of the mop shank.

2. The mop as claimed in claim 1, wherein the drive device is a spring.

3. A mop, comprising:

a mop head including a cleaning face comprising a first end portion and a second end portion which are articulated by and interconnected at a hinge device, so that the first end portion can be pivoted about the hinge device relative to the second end portion for forming a coplanar state or a non-coplanar state with the second end portion;

a mop shank;

a position-limit mechanism interfacing with the joint to limit movement of the joint relative to the mop head between the raised and lowered position to a linear path;

a joint connecting the mop head and the mop shank such that the mop shank can pivot relative to the mop head at the joint, wherein the joint is further movable relative to the mop head between a raised position and a lowered position; and a body extending between the first end portion and the joint, wherein the joint contacts the body, and further wherein the mop is configured such that the body transfers a force generated at the joint to the first end portion when transitioning from the raised position to the lowered position, causing the first end portion to pivot from the coplanar state to the non-coplanar state.

4. The mop as claimed in claim 3, wherein the mop head is provided with a driving device placed between the hinge device and the joint to exert a driving force therebetween.

5. The mop as claimed in claim 3, wherein the body is a crowbar stripe, when a force is exerted on the mop head through the mop shank, the joint is brought into contact with the crowbar stripe, and the first end portion of the cleaning face is rotated about the hinge device.

6. The mop as claimed in claim 5, wherein the driving device comprises a spring which is a coil spring and/or a flat spring bearing against the crowbar stripe.

7. The mop as claimed in claim 3, wherein the position-limit mechanism is located at a position close to a center of the mop head.

8. The mop as claimed in claim 3, wherein the cleaning face has a substantially planar surface having a plurality of convex and concave peaks and valleys therein.

9. The mop as claimed in claim 3, wherein each end portion of the mop head at least comprises a cleaning material disposed on the mop head and a gripping mechanism for fixing the cleaning material thereon.

10. The mop as claimed in claim 3, wherein the cleaning face is a flat sponge.

11. The mop as claimed in claim 3, wherein the mop is configured such that the joint transitions from the raised position to the lowered position in response to a downward force applied at the mop shank in a direction of the mop head.

12. The mop as claimed in claim 3, wherein the position-limit mechanism includes a slotted opening, and wherein the joint is moveable within the slotted opening.

* * * * *